US009962805B2

(12) United States Patent
Chang et al.

(10) Patent No.: US 9,962,805 B2
(45) Date of Patent: May 8, 2018

(54) CHEMICAL MECHANICAL POLISHING APPARATUS AND METHOD

(71) Applicant: Taiwan Semiconductor Manufacturing Company, Ltd., Hsin-Chu (TW)

(72) Inventors: Ting-Kui Chang, New Taipei (TW); Fu-Ming Huang, Shengang Township (TW); Liang-Guang Chen, Hsin-Chu (TW); Chun-Chieh Lin, Hsin-Chu (TW)

(73) Assignee: Taiwan Semiconductor Manufacturing Company, Ltd., Hsin-Chu (TW)

( * ) Notice: Subject to any disclaimer, the term of this patent is extended or adjusted under 35 U.S.C. 154(b) by 194 days.

(21) Appl. No.: 15/136,706

(22) Filed: Apr. 22, 2016

(65) Prior Publication Data

US 2017/0304990 A1 Oct. 26, 2017

(51) Int. Cl.
*B24B 37/00* (2012.01)
*B24B 37/20* (2012.01)
*B24B 37/005* (2012.01)

(52) U.S. Cl.
CPC ..... *B24B 37/20* (2013.01); *B24B 37/005* (2013.01)

(58) Field of Classification Search
CPC ..... B24B 37/20; B24B 37/005
USPC ..... 451/5, 41, 285–290
See application file for complete search history.

(56) References Cited

U.S. PATENT DOCUMENTS 4,802,309 A * 2/1989 Heynacher ..... B24B 13/015 451/168
5,584,746 A * 12/1996 Tanaka ..... B24B 37/30 451/288
5,695,601 A * 12/1997 Kodera ..... B24B 37/005 156/345.13
5,762,539 A * 6/1998 Nakashiba ..... B24B 37/30 451/285
5,791,970 A * 8/1998 Yueh ..... B24B 37/04 451/446
6,048,179 A * 4/2000 Forster ..... B60K 6/26 417/222.1
6,390,905 B1 * 5/2002 Korovin ..... B24B 37/30 451/286
6,447,368 B1 * 9/2002 Fruitman ..... B24B 37/013 451/287
6,572,446 B1 * 6/2003 Osterheld ..... B24B 37/20 451/24
6,764,379 B2 * 7/2004 Finarov ..... B24B 37/013 451/41
6,863,771 B2 * 3/2005 Brown ..... B24B 1/005 156/345.14
7,438,626 B2 * 10/2008 Blalock ..... B24B 1/04 451/41
7,980,922 B2 * 7/2011 Kiesel ..... B24B 57/02 451/10
9,662,761 B2 * 5/2017 Shinozaki ..... B24B 37/04
2003/0130732 A1 * 7/2003 Sarfarazi ..... A61F 2/1629 623/6.13

(Continued)

*Primary Examiner* — George Nguyen
(74) *Attorney, Agent, or Firm* — Slater Matsil, LLP

(57) ABSTRACT

A polisher head of a polishing apparatus includes a membrane and a first local pressure nodule and a second local pressure nodule physically contacting the membrane. The first local pressure nodule is configured to apply a first local force to the membrane and the second local pressure nodule is configured to apply a second local force to the membrane. The first local pressure nodule and the second local pressure nodule are independently controllable.

20 Claims, 8 Drawing Sheets

(56) References Cited

U.S. PATENT DOCUMENTS

| | | | | |
|---|---|---|---|---|
| 2004/0142635 | A1* | 7/2004 | Elledge | B24B 37/30 451/5 |
| 2004/0198180 | A1* | 10/2004 | Toprac | B24B 37/042 451/5 |
| 2005/0118930 | A1* | 6/2005 | Chandrasekaran | B24B 37/30 451/5 |
| 2007/0149094 | A1* | 6/2007 | Choi | B24B 37/20 451/8 |
| 2007/0167110 | A1* | 7/2007 | Tseng | B24B 37/30 451/5 |
| 2007/0233306 | A1* | 10/2007 | Takada | B24B 37/013 451/66 |
| 2008/0227367 | A1* | 9/2008 | Birang | B24B 37/013 451/6 |
| 2009/0250069 | A1* | 10/2009 | Frey | A47G 9/10 128/845 |
| 2009/0280723 | A1* | 11/2009 | Tabata | B24B 37/24 451/41 |
| 2011/0070807 | A1* | 3/2011 | Sudo | B24B 27/06 451/5 |
| 2014/0187122 | A1* | 7/2014 | Ishibashi | B24B 1/04 451/1 |
| 2014/0199917 | A1* | 7/2014 | Shibata | B24B 49/16 451/5 |
| 2014/0342640 | A1* | 11/2014 | Fukushima | B24B 37/005 451/24 |
| 2015/0111477 | A1* | 4/2015 | Suen | B24B 37/20 451/60 |
| 2017/0047237 | A1* | 2/2017 | Kobata | H01L 22/26 |

* cited by examiner

CHEMICAL MECHANICAL POLISHING APPARATUS AND METHOD

BACKGROUND

Generally, semiconductor devices comprise active components, such as transistors, formed on a substrate. Any number of interconnect layers may be formed over the substrate connecting the active components to each other and to outside devices. The interconnect layers are typically made of low-k dielectric materials comprising metallic trenches/vias.

As the layers of a device are formed, it is sometimes necessary to planarize the device. For example, the formation of metallic features in the substrate or in a metal layer may cause uneven topography. This uneven topography creates difficulties in the formation of subsequent layers. For example, uneven topography may interfere with the photolithographic process commonly used to form various features in a device. It is, therefore, desirable to planarize the surface of the device after various features or layers are formed.

One commonly used method of planarization is via chemical mechanical polishing (CMP). Typically, CMP involves placing a wafer in a carrier head, wherein the wafer is held in place by a retaining ring. The carrier head and the wafer are then rotated as downward pressure is applied to the wafer against a polishing pad. A chemical solution, referred to as a slurry, is deposited onto the surface of the polishing pad to aid in the planarizing. Ideally, the retaining ring comprises a multitude of grooves to facilitate the even distribution of the slurry over the wafer surface. When retaining rings without any grooves are used during CMP, the resulting wafers tend to suffer topographical unevenness due to irregular slurry disposition. Thus, the surface of a wafer may be planarized using a combination of mechanical (the grinding) and chemical (the slurry) forces.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1:
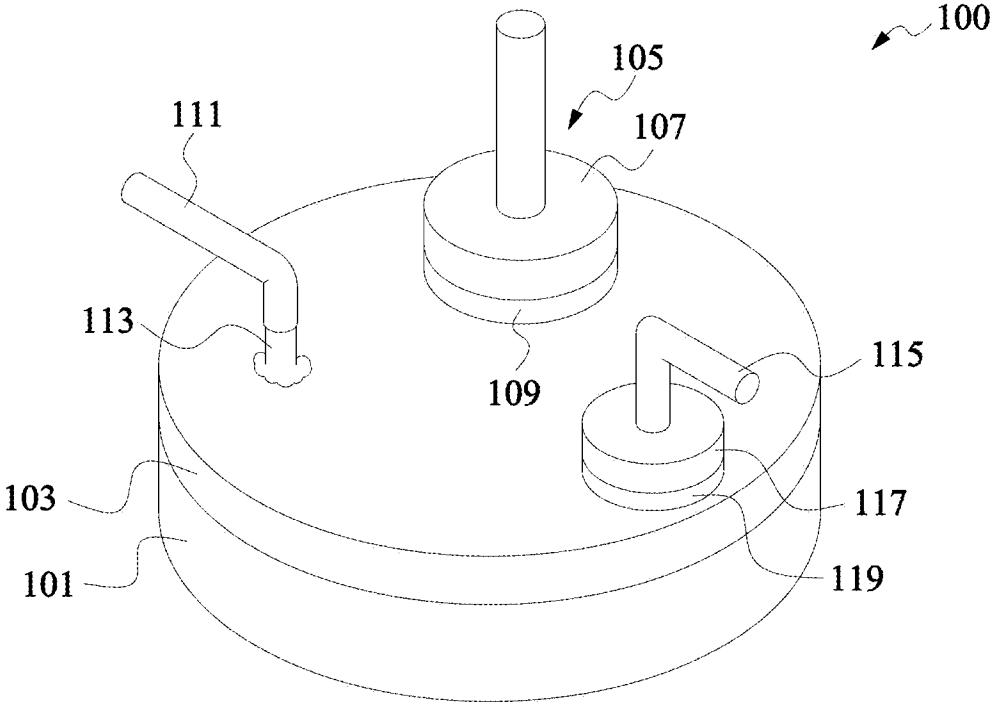
FIG. 1 illustrates a perspective view of a CMP apparatus in accordance with some embodiments.

The following disclosure provides many different embodiments, or examples, for implementing different features of the invention. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

Various embodiments are described with respect to a specific context, namely a chemical mechanical polishing (CMP) apparatus and a method of polishing a semiconductor wafer using the CMP apparatus. Various embodiments include a polisher head having local pressure nodules configured to apply a non-uniform down force to a semiconductor wafer during a CMP process. The local pressure nodules allow for independently controlling the force applied to different regions of a semiconductor wafer and allow for compensating for a thickness asymmetry or a thickness non-uniformity of a polished layer of a semiconductor wafer. The use of local pressure nodules further allows for reducing polishing time and allows for increasing a wafer per hour (WPH) output of a CMP apparatus in some embodiments. Various embodiments further allow for configuring local pressure nodules to apply a non-uniform force to a semiconductor wafer based on a non-uniform thickness of a polished layer of a semiconductor wafer.

FIG. 1 illustrates a perspective view of a CMP apparatus 100 in accordance with some embodiments. In some embodiments, the CMP apparatus 100 includes a platen 101 over which a polishing pad 103 has been placed. In some embodiments, the polishing pad 103 may be a single layer or a composite layer of materials such as felts, polymer impregnated felts, microporous polymers films, microporous synthetic leathers, filled polymer films, unfilled textured polymer films, or the like. The polymers may include polyurethane, polyolefins, or the like.

In some embodiments, a polisher head 105 is placed over the polishing pad 103. The polisher head 105 includes a carrier 107 and a retainer ring 109. In some embodiments, the retainer ring 109 is mounted to the carrier 107 using mechanical fasteners such as screws or by any other suitable means. During a CMP process, a wafer (not shown in FIG. 1, see FIG. 3) is placed within the carrier 107 and is held by the retainer ring 109. In some embodiments, the retainer ring 109 has an annular shape with a hollow center. The wafer is placed in the hollow center of retainer ring 109 such that the retainer ring 109 holds the wafer in place during a CMP process. The wafer is positioned so that the surface to be polished faces downward towards the polishing pad 103. The carrier 107 is configured to apply a downward force or pressure and causes the wafer to come in contact with polishing pad 103. The polisher head 105 is configured to rotate and rotates an attached wafer over the polishing pad 103 during a CMP process.

In some embodiments, the CMP apparatus 100 includes a slurry dispenser 111, which is configured to deposit a slurry 113 onto the polishing pad 103. The platen 101 is configured to rotate and causes the slurry 113 to be distributed between the wafer and the platen through a multitude of grooves (not shown) in the retainer ring 109, which may extend from an outer sidewall of the retainer ring 109 to an inner sidewall of the retainer ring 109. The composition of the slurry 113 depends on a type of material to be polished. For example, the slurry may comprise a reactant, an abrasive, a surfactant, and a solvent. The reactant may be a chemical, such as an oxidizer or a hydrolyzer, which will chemically react with a material of the wafer in order to assist the polishing pad 103 in grinding away the material. In some embodiments in which the material is tungsten, the reactant may be hydrogen peroxide, although any other suitable reactant, such as hydroxylamine, periodic acid, ammonium persulfate, other periodates, iodates, peroxomonosulfates, peroxymonosulfuric acid, perborates, malonamide, combinations of these, and the like, that will aid in the removal of the material may alternatively be utilized. Other reactants may be used in order to remove other materials. For example, in some embodiments in which the material is an oxide, the reactant may comprise $HNO_3$, KOH, $NH_4OH$, or the like.

The abrasive may be any suitable particulate that, in conjunction with the polishing pad 103, aids in the polishing of the wafer. In some embodiments, the abrasive may comprise silica, aluminum oxide, cerium oxide, polycrystalline diamond, polymer particles such as polymethacrylate or polymethacryclic, combinations of these, or the like.

The surfactant may be utilized to help disperse the reactant and abrasive within the slurry 113 and to prevent (or at least reduce) the abrasive from agglomerating during a CMP process. In some embodiments, the surfactant may include sodium salts of polyacrylic acid, potassium oleate, sulfosuccinates, sulfosuccinate derivatives, sulfonated amines, sulfonated amides, sulfates of alcohols, alkylanyl sulfonates, carboxylated alcohols, alkylamino propionic acids, alkyliminodipropionic acids, potassium oleate, sulfosuccinates, sulfosuccinate derivatives, sulfates of alcohols, alkylanyl sulfonates, carboxylated alcohols, sulfonated amines, sulfonated amides, alkylamino propionic acids, alkyliminodipropionic acids, combinations of these, or the like. However, these embodiments are not intended to be limited to these surfactants, as any suitable surfactant may alternatively be utilized as the surfactant.

The remainder of the slurry 113 may be a solvent that may be utilized to combine the reactant, the abrasive, and the surfactant and allow the mixture to be moved and dispersed onto the polishing pad 103. In some embodiments, the solvent of the slurry 113 may be a solvent such as deionized (DI) water or an alcohol. However, any other suitable solvent may alternatively be utilized.

In some embodiments, the CMP apparatus 100 includes a pad conditioner 119 attached to a pad conditioner head 117. The pad conditioner head 117 is configured to rotate and rotates the pad conditioner 119 over the polishing pad 103. In some embodiments, the pad conditioner 119 is mounted to the pad conditioner head 117 using mechanical fasteners such as screws or by any other suitable means. A pad conditioner arm 115 is attached to the pad conditioner head 117 and is configured to move the pad conditioner head 117 and the pad conditioner 119 in a sweeping motion across a region of the polishing pad 103. In some embodiments, the pad conditioner head 117 is mounted to the pad conditioner arm 115 using mechanical fasteners such as screws or by any other suitable means. In some embodiments, the pad conditioner 119 comprises a substrate over which an array of abrasive particles, such as diamonds, is bonded using, for example, electroplating. The pad conditioner 119 removes built-up wafer debris and excess slurry from the polishing pad 103 during a CMP process. In some embodiments, the pad conditioner 119 also acts as an abrasive for the polishing pad 103 to create an appropriate texture (such as, for example, grooves, or the like) against which the wafer may be properly polished.

Referring to further to FIG. 1, in the illustrated embodiment, the CMP apparatus 100 has a single polisher head (such as the polisher head 105) and a single polishing pad (such as the polishing pad 103). However, in other embodiments, the CMP apparatus 100 may have multiple polisher heads and/or multiple polishing pads. In some embodiments in which the CMP apparatus 100 has multiple polisher heads and a single polishing pad, multiple wafers may be polished at the same time. In other embodiments in which the CMP apparatus 100 has a single polisher head and multiple polishing pads, a CMP process may be a multi-step process. In such embodiments, a first polishing pad may be used for bulk material removal from a wafer, a second polishing pad may be used for global planarization of the wafer and a third polishing pad may be used to buff a surface of the wafer. In some embodiments, different slurries may be used for different CMP stages. In other embodiments, the same slurry may be used for all CMP stages.

Figure 2:
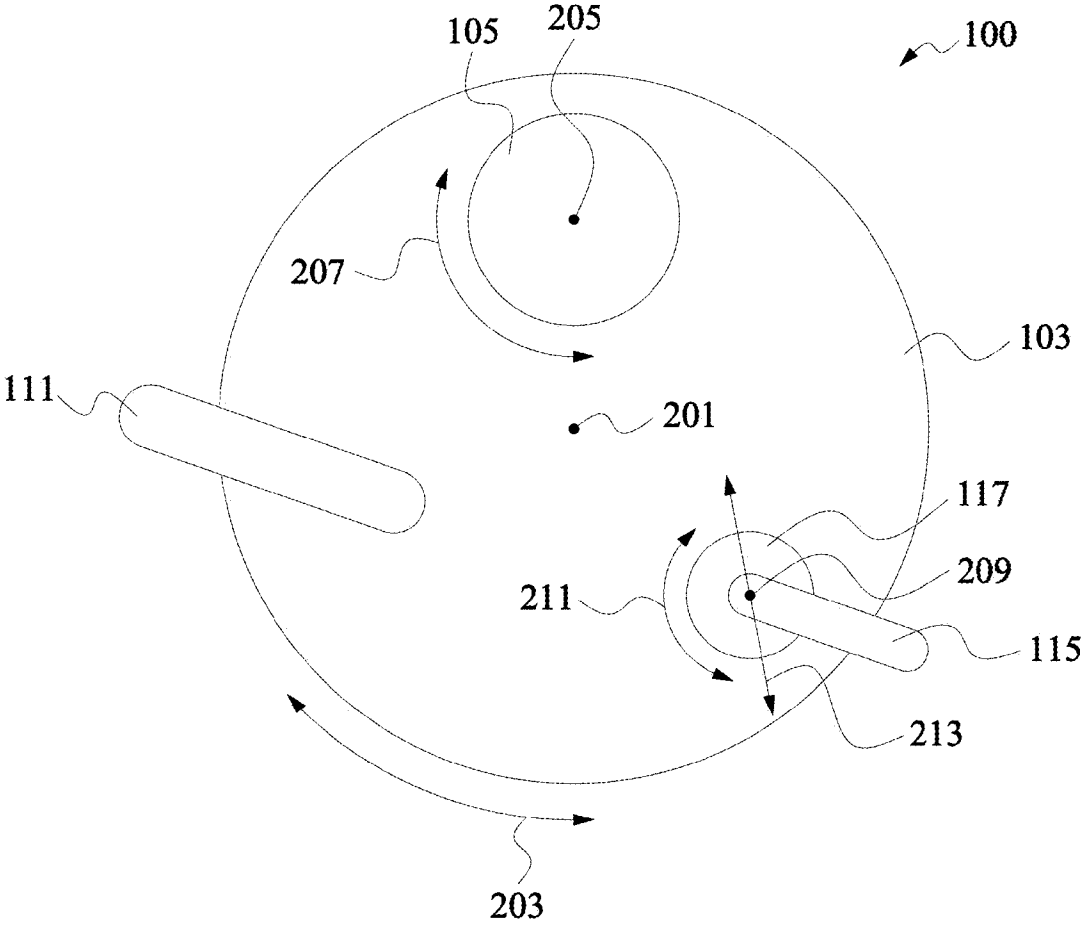
FIG. 2 illustrates a top view of a CMP apparatus in accordance with some embodiments.

FIG. 2 illustrates a top view of the CMP apparatus 100 in accordance with some embodiments. In some embodiments, the platen 101 is configured to rotate in a clockwise or a counter-clockwise direction indicated by a double-headed arrow 203 around an axis extending through a point 201, which is a center point of the platen 101. The polisher head 105 is configured to rotate in a clockwise or a counter-clockwise direction indicated by a double-headed arrow 207 around an axis extending through a point 205, which is a center point of the polisher head 105. In some embodiment, the axis through the point 201 is parallel to the axis through the point 205. In some embodiment, the axis through the point 201 is spaced apart from the axis through the point 205. In some embodiments, the pad conditioner head 117 is configured to rotate in a clockwise or a counter-clockwise direction indicated by a double-headed arrow 211 around an axis extending through a point 209, which is a center point of the pad conditioner head 117. In some embodiments, the axis through the point 201 is parallel to the axis through the point 209. The pad conditioner arm 115 is configured to move the pad conditioner head 117 in an arc as indicated by a double-headed arrow 213.

Figure 3:
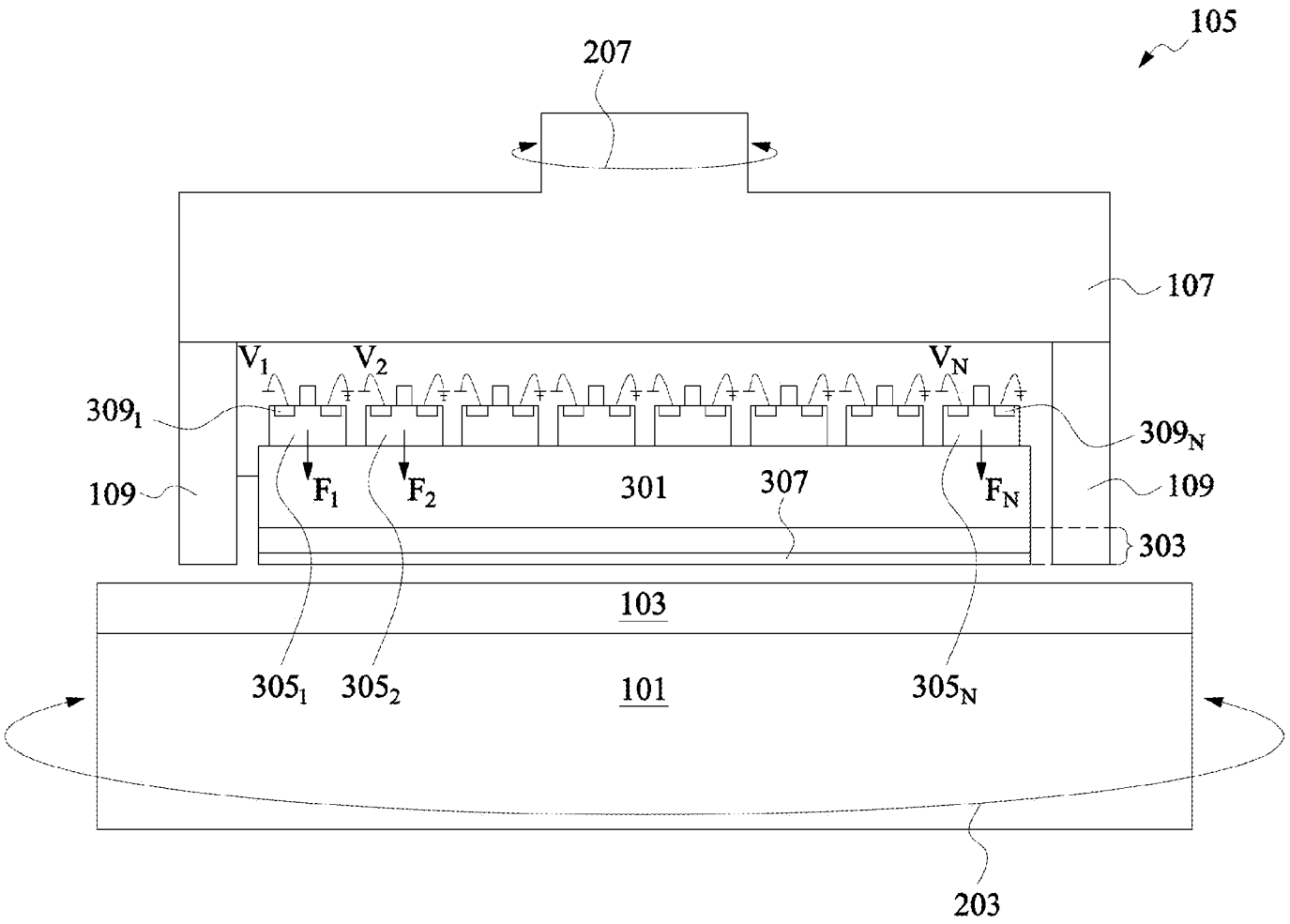
FIG. 3 illustrates a cross-sectional view of a polisher head in accordance with some embodiments.

FIG. 3 illustrates a cross-sectional view of the polisher head 105 in accordance with some embodiments. In some embodiments, the carrier 107 includes a membrane 301 that interfaces with a wafer 303 during a CMP process. In some embodiments, the CMP apparatus 100 includes a vacuum system (not shown) coupled to the polisher head 105 and the membrane 301 is configured to pick up and hold the wafer 303 using vacuum suction on the membrane 301. In some embodiments, the wafer 303 may be a semiconductor wafer comprising, for example, a semiconductor substrate (e.g., comprising silicon, III-V semiconductor materials, or the like), active devices (e.g., transistors) on the semiconductor substrate, and/or various interconnect structures. The interconnect structure may include conductive features, which electrically connect the active devices in order to form functional circuits. In various embodiments, CMP processing may be applied to the wafer 303 during any stage of manufacture in order to planarize, reduce, or remove features (e.g., dielectric material, semiconductor material, and/or conductive material) of the wafer 303. Thus, the wafer 303 being processed may include any subset of the above features as well as other features. In some embodiments, the wafer 303 comprises a bottommost layer 307 to be polished during a CMP process. In some embodiments in which the bottommost layer 307 comprises tungsten, the bottommost layer 307 may be polished to form contact plugs contacting various active devices of the wafer 303. In some embodiments in which the bottommost layer 307 comprises copper, the bottommost layer 307 may be polished to form various interconnect structures of the wafer 303. In some embodiments in which the bottommost layer 307 comprises a dielectric material, the bottommost layer 307 may be polished to form shallow trench isolation structures on the wafer 303.

Referring further to FIG. 3, in some embodiments, the carrier 107 includes N local pressure nodules $\mathbf{305}_1$ to $\mathbf{305}_N$ that are configured to independently exert a local force or a local pressure onto the wafer 303 through the membrane 301. For the clarity of presentation only the local pressure nodules $\mathbf{305}_1$, $\mathbf{305}_2$ and $\mathbf{305}_N$ are labeled in FIG. 3. The local pressure nodules $\mathbf{305}_1$ to $\mathbf{305}_N$ are configured to be controlled independently and to apply independent local forces $F_1$ to $F_N$, respectively, to the membrane 301 and to the wafer 303 attached to the membrane 301. In what follows the local forces $F_1$ to $F_N$ may be collectively referred to as a force field. Through such an independent control, a force field of any desired configuration may be applied to the wafer 303. In some embodiments, the force field may be a uniform force field. In other embodiments, the force field may be a non-uniform force field.

In some embodiments, the local pressure nodules $\mathbf{305}_1$ to $\mathbf{305}_N$ may be electrically controllable and may comprise a piezoelectric material such as quartz, lithium niobate, barium titanate, lead zirconate titanate (PZT), or the like. The local pressure nodules $\mathbf{305}_1$ to $\mathbf{305}_N$ may further comprise electrical contacts $\mathbf{309}_1$ to $\mathbf{309}_N$, respectively. In such embodiments, through the inverse piezoelectric effect, the local pressure nodules $\mathbf{305}_1$ to $\mathbf{305}_N$ may be deformed by applying voltages $V_1$ to $V_N$, respectively, to the electrical contacts $\mathbf{309}_1$ to $\mathbf{309}_N$ of the local pressure nodules $\mathbf{305}_1$ to $\mathbf{305}_N$. The voltages $V_1$ to $V_N$ cause the local pressure nodules $\mathbf{305}_1$ to $\mathbf{305}_N$ to stretch towards the membrane 301 and apply local forces $F_1$ to $F_N$, respectively, to the wafer 303. In some embodiments, the CMP apparatus 100 includes a controller (not shown), which is configured to provide voltages $V_1$ to $V_N$ to the local pressure nodules $\mathbf{305}_1$ to $\mathbf{305}_N$, such that the voltages $V_1$ to $V_N$ are independent form each other. In some embodiments, by providing independent voltages V, to $V_N$ to the local pressure nodules 305, to $\mathbf{305}_N$, the local pressure nodules 305, to $\mathbf{305}_N$ may be independently deformed and may apply independent local forces F, to $F_N$ to the wafer 303. In some embodiments, for each i=1 to N, the voltage $V_i$ between about 0 mV and about 30 mV may be applied to the local pressure nodule $\mathbf{305}_i$, which in turn applies a local force $F_i$ between about 0.1 N and about 1 N to the wafer 303. In some embodiments, each of the local pressure nodules $\mathbf{305}_1$ to $\mathbf{305}_N$ may apply a pressure between about 50 hpa and about 500 hpa to the wafer 303.

In other embodiments, the local pressure nodules $\mathbf{305}_1$ to $\mathbf{305}_N$ may be pressure controllable, may comprise flexible sidewalls and may be configured to hold a fluid. In some embodiments, the fluid may comprise a suitable gas or liquid. The CMP apparatus 100 may include one or more pumps (not shown), which are configured to independently control pressures $P_1$ to $P_N$ of a fluid held by the local pressure nodules $\mathbf{305}_1$ to $\mathbf{305}_N$, respectively. In such embodiments, the flexible sidewalls of the local pressure nodules $\mathbf{305}_1$ to $\mathbf{305}_N$ are deformed (for example, stretched) in response to the pressures $P_1$ to $P_N$. By independently controlling the pressures $P_1$ to $P_N$, the flexible sidewalls of the local pressure nodules $\mathbf{305}_1$ to $\mathbf{305}_N$ may be independently deformed and may apply independent local forces $F_1$ to $F_N$ to the wafer 303.

Figure 4:
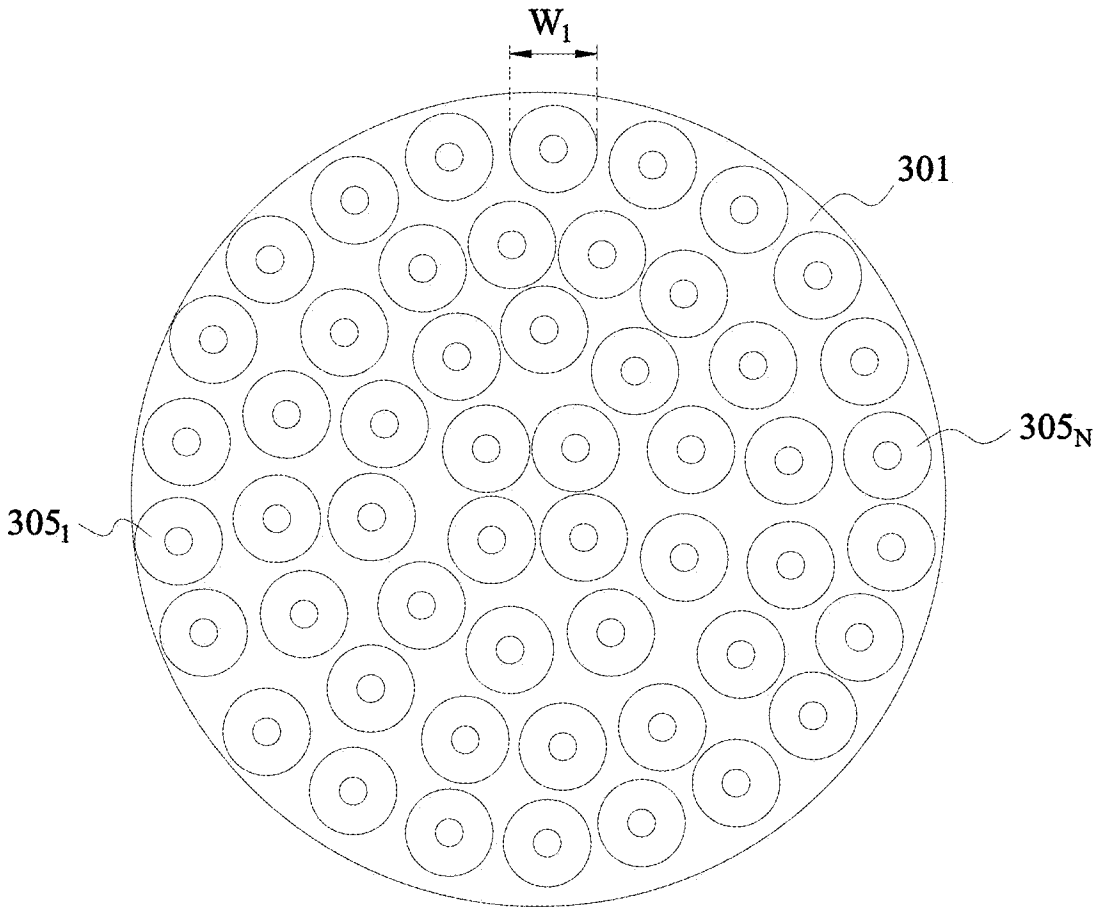
FIG. 4 illustrates a top view of a membrane with local pressure nodules in accordance with some embodiments.

FIG. 4 illustrates a top view of the membrane 301 with the local pressure nodules 305 in accordance with some embodiments. In the illustrated embodiment, top-view shapes of the local pressure nodules $\mathbf{305}_1$ to $\mathbf{305}_N$ are circles. In other embodiments, top-view shapes of the local pressure nodules $\mathbf{305}_1$ to $\mathbf{305}_N$ may be ovals, squares, rectangles, or the like. In some embodiments, the local pressure nodules $\mathbf{305}_1$ to $\mathbf{305}_N$ may have a width W, between about 1.5 cm and about 3.5 cm, such as about 2.54 cm (1 in). In FIG. 4, a particular number and arrangement of the local pressure nodules $\mathbf{305}_1$ to $\mathbf{305}_N$ are provided for illustrative purposes only. One skilled in the art would appreciate that the number and arrangement of the local pressure nodules $\mathbf{305}_1$ to $\mathbf{305}_N$ may vary according to design requirements of the CMP apparatus 100.

Figure 5:
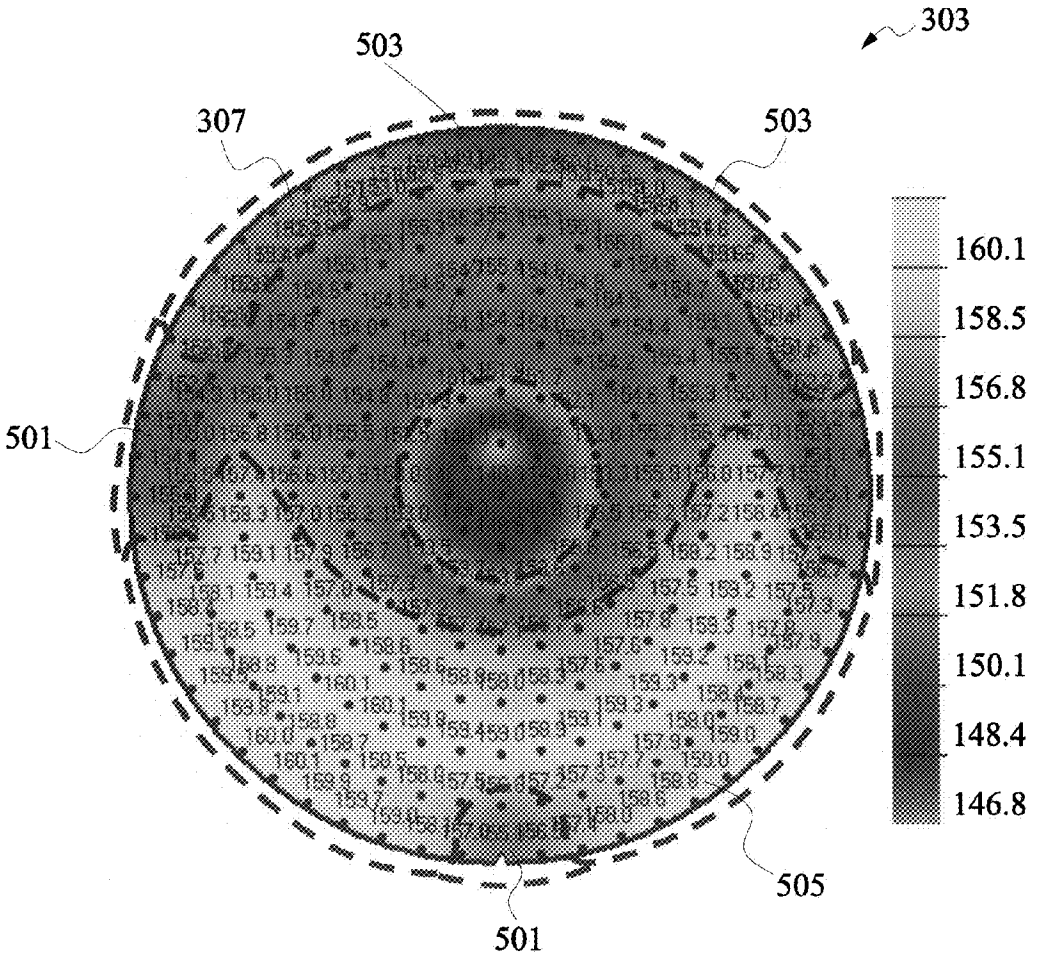
FIG. 5 illustrates a bottom view of a semiconductor wafer in accordance with some embodiments.

FIG. 5 illustrates thicknesses of the bottommost layer 307 of an exemplary wafer 303 in accordance with some embodiments. In some embodiments, the bottommost layer 307 may have a non-uniform thickness, for example, due to process variations during forming the bottommost layer 307. In the illustrated embodiment, the bottommost layer 307 is formed by depositing tungsten using a CVD process. Due to CVD process variations the bottommost layer 307 has a non-uniform thickness ranging from about 146.8 nm to about 160.1 nm, with a mean value of about 155.4 nm and a standard deviation of about 2.97 nm. Based on the non-uniform thickness of the bottommost layer 307, various regions of the bottommost layer 307 may be identified. In some embodiments, the bottommost layer 307 may be separated into a plurality of regions, such that each region may have a nearly uniform thickness. In the illustrated embodiment, the bottommost layer 307 has a first region 501, a second region 503 and a third region 505. A thickness of the first region 501 is similar to the average thickness of the bottommost layer 307. A thickness of the second region 503 is less than the average thickness of the bottommost layer 307. A thickness of the third region 505 is greater than the average thickness of the bottommost layer 307. As described below in greater detail, the local pressure nodules $\mathbf{305}_1$ to $\mathbf{305}_N$ are configured such that the local pressure nodules $\mathbf{305}_1$ to $\mathbf{305}_N$ apply a non-uniform force field to the wafer 303 to more efficiently polish the bottommost layer 307 of the wafer 303.

Figure 6:
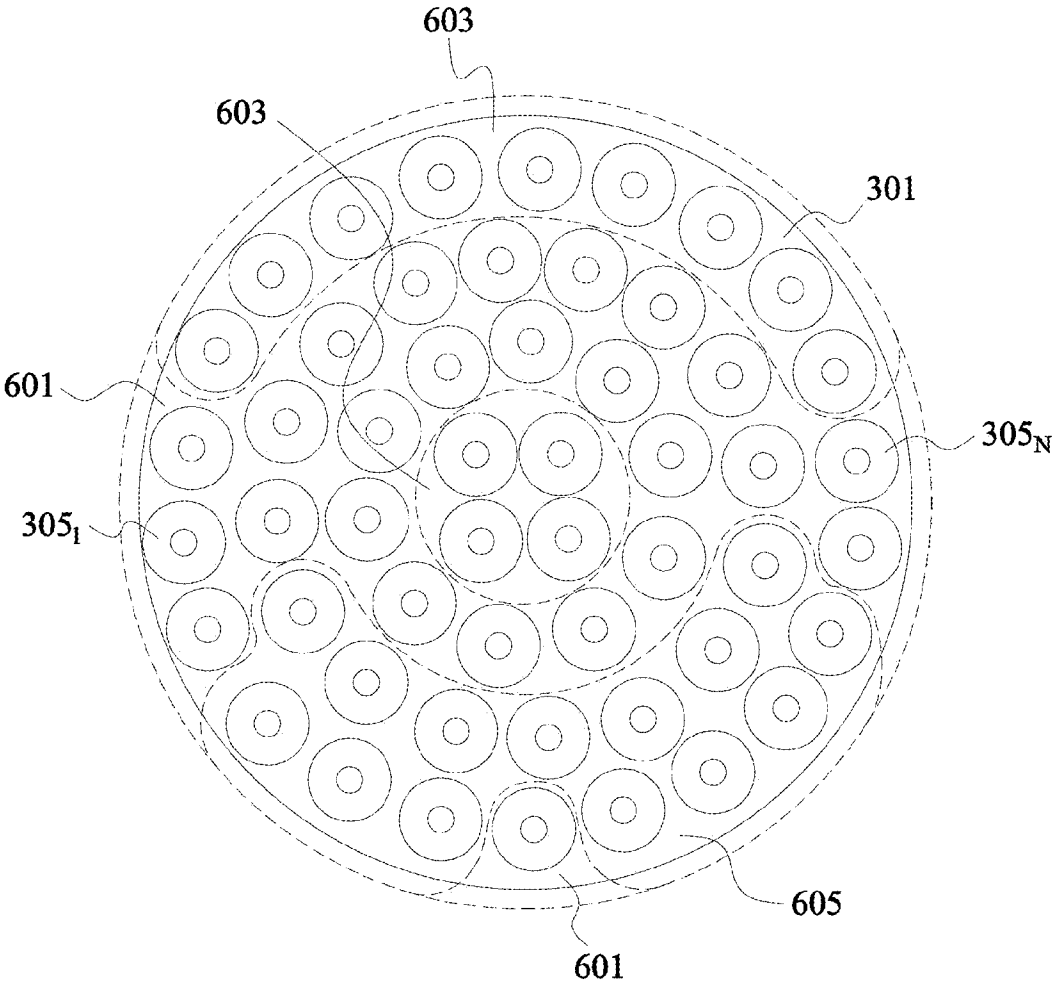
FIG. 6 illustrates a top view of a membrane with local pressure nodules, with the local pressure nodules configured to apply a non-uniform force to a semiconductor wafer in accordance with some embodiments.

FIG. 6 illustrates a top view of the membrane 301 with the local pressure nodules $\mathbf{305}_1$ to $\mathbf{305}_N$, with the local pressure nodules $305_1$ to $305_N$ configured to apply a non-uniform force field to the wafer 303 (see FIG. 3) in accordance with some embodiments. For the clarity of presentation only the local pressure nodules $305_1$ and $305_N$ are labeled in FIG. 6. In some embodiments, the local forces $F_1$ to $F_N$ to be applied by the local pressure nodules $305_1$ to $305_N$, respectively, may be determined independently for each of the local pressure nodules $305_1$ to $305_N$. In such embodiments, the local forces $F_1$ to $F_N$ to be applied by the local pressure nodules $305_1$ to $305_N$, respectively, may be determined based on local thicknesses of the bottommost layer 307 immediately below the respective local pressure nodules $305_1$ to $305_N$. In some embodiments, the local forces $F_1$ to $F_N$ may be proportional to local thicknesses of the bottommost layer 307. In other embodiments, other functional dependencies between the local forces $F_1$ to $F_N$ and the thicknesses of the bottommost layer 307 may be used.

Referring further to FIG. 6, in some embodiments, the local forces $F_1$ to $F_N$ to be applied by the local pressure nodules $305_1$ to $305_N$, respectively, may be determined by grouping the local pressure nodules $305_1$ to $305_N$ into a plurality of groups such that each of the local pressure nodules in a group is configured to apply a nearly same local force to the wafer 303. For example, to polish the bottommost layer 307 of the wafer 303 illustrate in FIG. 5, the local pressure nodules $305_1$ to $305_N$ may be grouped into a plurality of groups that correspond to the regions 501, 503 and 505 of the bottommost layer 307. In the illustrated embodiment, the local pressure nodules $305_1$ to $305_N$ are grouped into a first group 601, a second group 603 and a third group 605. The first group 601 corresponds to the first region 501 (see FIG. 5) of the bottommost layer 307 and each local pressure nodule in the first group 601 is configured to apply a first force to the wafer 303. The second group 603 corresponds to the second region 503 (see FIG. 5) of the bottommost layer 307 and each local pressure nodule in the second group 603 is configured to apply a second force to the wafer 303, with the second force being lower than the first force. The third group 605 corresponds to the third region 505 (see FIG. 5) of the bottommost layer 307 and each local pressure nodule in the third group 605 is configured to apply a third force to the wafer 303, with the third force being higher than the first force.

Figure 7:
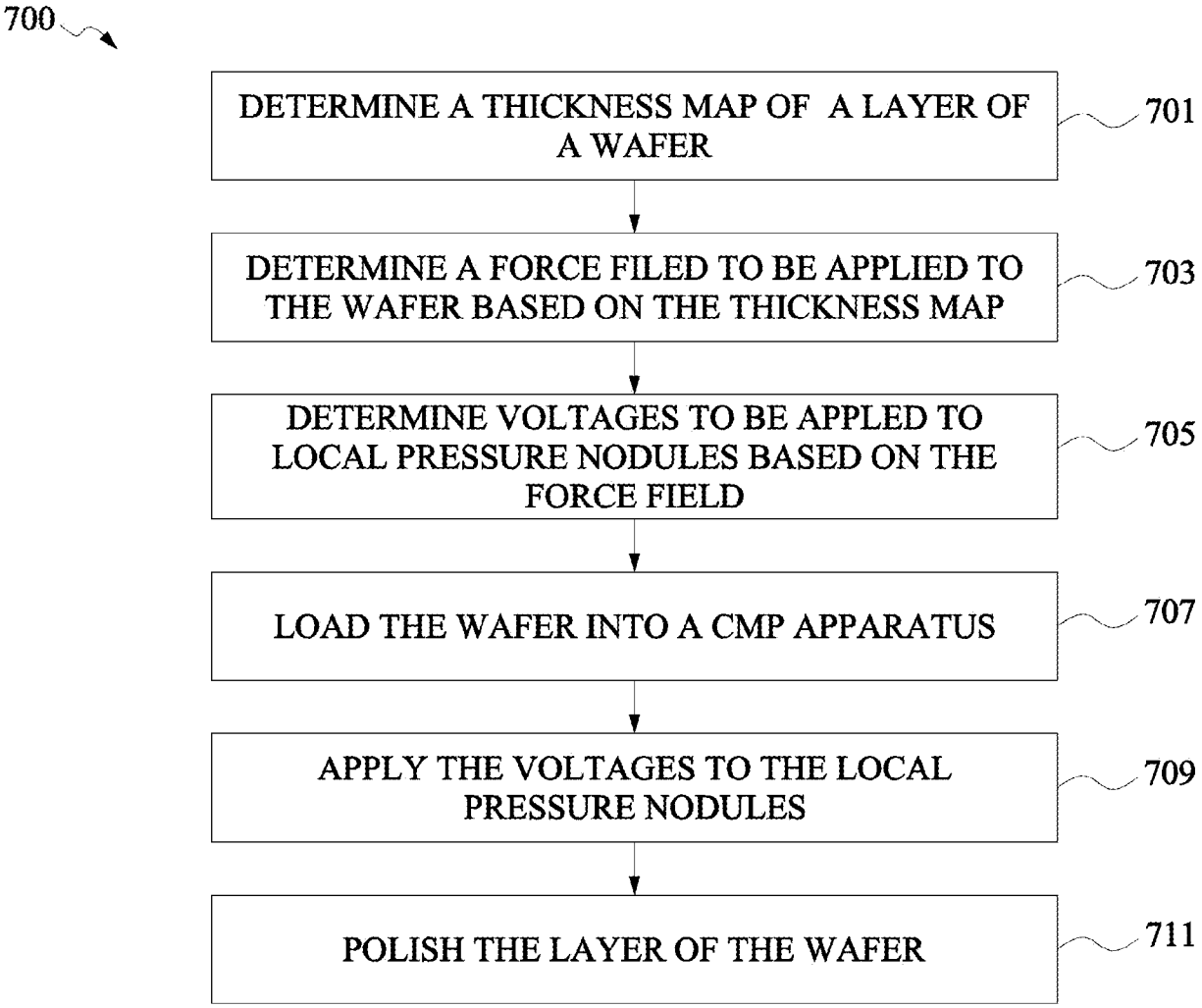
FIG. 7 is a flow diagram of a method of polishing a semiconductor wafer in accordance with some embodiments.

FIG. 7 is a flow diagram of a method 700 of polishing a semiconductor wafer in accordance with some embodiments. Referring to FIGS. 5 and 7, the method starts with step 701, where a thickness map of the bottommost layer 307 of the wafer 303 is determined. The thickness map of the bottommost layer 307 may be determined by measuring a thickness of the bottommost layer 307 or using empirical data from previous processes. In some embodiments, the thickness of the bottommost layer 307 may be measured using ellipsometry, interferometry, reflectometry, picosecond ultrasonics, atomic force microscopy (AFM), scanning tunneling microscopy (STM), scanning electron microscopy (SEM), transmission electron microscopy (TEM), or the like. In the illustrated embodiment, a thickness measurement apparatus (not shown) is external from the CMP apparatus 100 and the thickness map of the bottommost layer 307 is determined before loading the wafer 330 into the CMP apparatus 100. In other embodiments, the thickness measurement apparatus may be a part of the CMP apparatus 100 and the thickness map of the bottommost layer 307 is determined after loading the wafer 330 into the CMP apparatus 100.

Referring to FIGS. 5-7, in step 703, a force field to be applied to the wafer 303 during a CMP process is determined based on the thickness map of the bottommost layer 307. The force field is a collection of local forces $F_1$ to $F_N$ to be applied to the wafer 303 using individual local pressure nodules $305_1$ to $305_N$. In some embodiments, the force field may be determined using a method as described above with reference to FIG. 6.

Referring to FIGS. 5-7, in step 705, voltages $V_1$ to $V_N$ to be applied to the local pressure nodules $305_1$ to $305_N$, respectively, are determined based on the desired force field. In some embodiments, the voltages $V_1$ to $V_N$ to be applied to the local pressure nodules $305_1$ to $305_N$ may be determined based on the inverse piezoelectric effect. The voltages $V_1$ to $V_N$ to be applied to the local pressure nodules $305_1$ to $305_N$ are voltages that after being applied to the local pressure nodules $305_1$ to $305_N$ cause the local pressure nodules $305_1$ to $305_N$ to change shape and apply the desired local forces $F_1$ to $F_N$ to the wafer 303 during a CMP process.

Referring to FIGS. 1-3 and 7, in step 707, the wafer 303 is loaded into the CMP apparatus 100. In some embodiments, the polisher head 105 may be lowered towards the wafer 303 placed on a stage (not illustrated). The carrier 107 may pick up the wafer 303 from the stage using vacuum suction on the membrane 301 so that the wafer 303 is disposed within an opening of the retainer ring 109 as illustrated in FIG. 3. In some embodiments, the polisher head 105 may be lowered towards the polishing pad 103 for polishing the wafer 303. The wafer 303 is positioned so that the layer to be planarized (such as the bottommost layer 307) faces towards the polishing pad 103. Other methods of disposing the wafer 303 over the polishing pad 103 may be used as well. For example, in other embodiments, the wafer 303 may be placed on the polishing pad 103 using a different mechanism, and the polisher head 105 may be lowered onto the wafer 303 while the wafer 303 is on the polishing pad 103.

Referring to FIGS. 1-3 and 7, in step 709, the voltages $V_1$ to $V_N$ determined in step 705 are applied to the local pressure nodules $305_1$ to $305_N$, respectively, such that the local pressure nodules $305_1$ to $305_N$ apply the desired local forces $F_1$ to $F_N$ to the wafer 303 as determined in step 703. In some embodiments, the voltages $V_1$ to $V_N$ determined in step 705 are applied to the local pressure nodules $305_1$ to $305_N$ using a controller (not show) that is configured to apply the desired voltages $V_1$ to $V_N$ to the local pressure nodules $305_1$ to $305_N$, such that the voltages $V_1$ to $V_N$ are independent from each other.

Referring to FIGS. 1-3 and 7, in step 711, the wafer 303 is polished. During a CMP process the local pressure nodules $305_1$ to $305_N$ apply the force forces $F_1$ to $F_N$ determined in step 703 to the membrane 301 and the membrane 301 pushes the wafer 303 onto the polishing pad 103 as illustrated in FIG. 3. The wafer 303 is polished by rotating the polisher head 105 and/or the polishing pad 103/platen 101 as indicated by double-headed arrows 207 and 203, respectively. In some embodiments, the polisher head 105 and the polishing pad 103/platen 101 may be rotated in a same direction. In other embodiments, the polisher head 105 and the polishing pad 103/platen 101 may be rotated in opposite directions. By rotating the wafer 303 against the polishing pad 103, the polishing pad 103 mechanically grinds the bottommost layer 307 of the wafer 303 to remove undesirable material of the bottommost layer 307.

Referring further to FIGS. 1-3, the slurry 113 is dispensed over a top surface of the polishing pad 103 by the slurry dispenser 111. In some embodiments, a gap may be disposed between the retainer ring 109 and the polishing pad 103 during a CMP process to allow the slurry 113 to be distributed under the bottommost layer 307 of the wafer 303. In other embodiments, the retainer ring 109 may contact the polishing pad 103 and the slurry 113 may be distributed under the bottommost layer 307 of the wafer 303 using one or more groves (not shown) extending from an outer sidewall to an inner sidewall of the retainer ring 109.

Referring further to FIGS. 1-3, during a CMP process, the pad conditioner arm 115 may move the pad conditioner head 117 and the pad conditioner 119 in a sweeping motion over a region of the polishing pad 103. The pad conditioner 119 may be used to remove built-up wafer debris and excess slurry from the polishing pad 103. The pad conditioner 119 may also acts as an abrasive for the polishing pad 103 to create an appropriate texture against which the wafer 303 may be mechanically ground. In some embodiments, the pad conditioning head 117/pad conditioner 119 may rotate in directions indicated by the double-headed arrow 211. In some embodiments, the pad conditioning head 117/pad conditioner 119 and the platen 101/polishing pad 103 may rotate in a same direction. In other embodiments, the pad conditioning head 117/pad conditioner 119 and the platen 101/polishing pad 103 may rotate in opposite directions. In some embodiments, the pad conditioner arm 115 may move the pad conditioning head 117/pad conditioner 119 in an arc indicated by the double-headed arrow 213. In some embodiments, the range of the arc corresponds to the size of the carrier 107. For example, the carrier 107 may be larger than 300 mm in diameter to accommodate 300 mm wafers. Accordingly, the arc would extend from the perimeter of the platen 101/polishing pad 103 to a distance of at least 300 mm inward from that perimeter. This ensures that any portion of polishing pad 103 that may contact the wafer 303 is conditioned appropriately. One skilled in the art would recognize that the numbers given in this paragraph are exemplary. The actual dimensions of the carrier 107 and the corresponding range of the arc may vary depending on the dimensions of the wafer 303 being polished.

In some embodiments, the force field applied to the wafer 303 in step 709 is static and does not change during the polishing process. In other embodiments, the force field applied to the wafer 303 may be dynamically adjusted one or more times during the polishing process. As the wafer 303 is polished and the thickness map of the bottommost layer 307 changes, the force field applied by the local pressure nodules $\mathbf{305}_1$ to $\mathbf{305}_N$ may be adjusted accordingly. In such embodiments, steps 701, 703, 705 and 709 may be repeated one or more times during preforming step 711.

In some embodiments, the CMP process may be a one-step CMP process (e.g., where a single polishing pad 103 is used) or a multi-step CMP process. In a multi-step CMP process, the polishing pad 103 may be used during a bulk CMP process. In such embodiments, the wafer 303 may be removed from the polishing pad 103 and may be transferred to a second polishing pad (not illustrated). The second polishing pad may perform a similar CMP process as described above and the description is not repeated herein. In some embodiments, the second polishing pad may be a soft buffing pad which may polish the wafer 303 at a slower and more controlled rate than the first polishing pad 206 while also buffing and eliminating defects and scratches that may have been caused by the bulk CMP process. The buffing CMP process may be continued until desired materials have been removed from the bottommost layer 307 of the wafer 303. In some embodiments, timed or optical end-point detection methods may be used to determine when to stop the polishing of the wafer 303.

Figure 8:
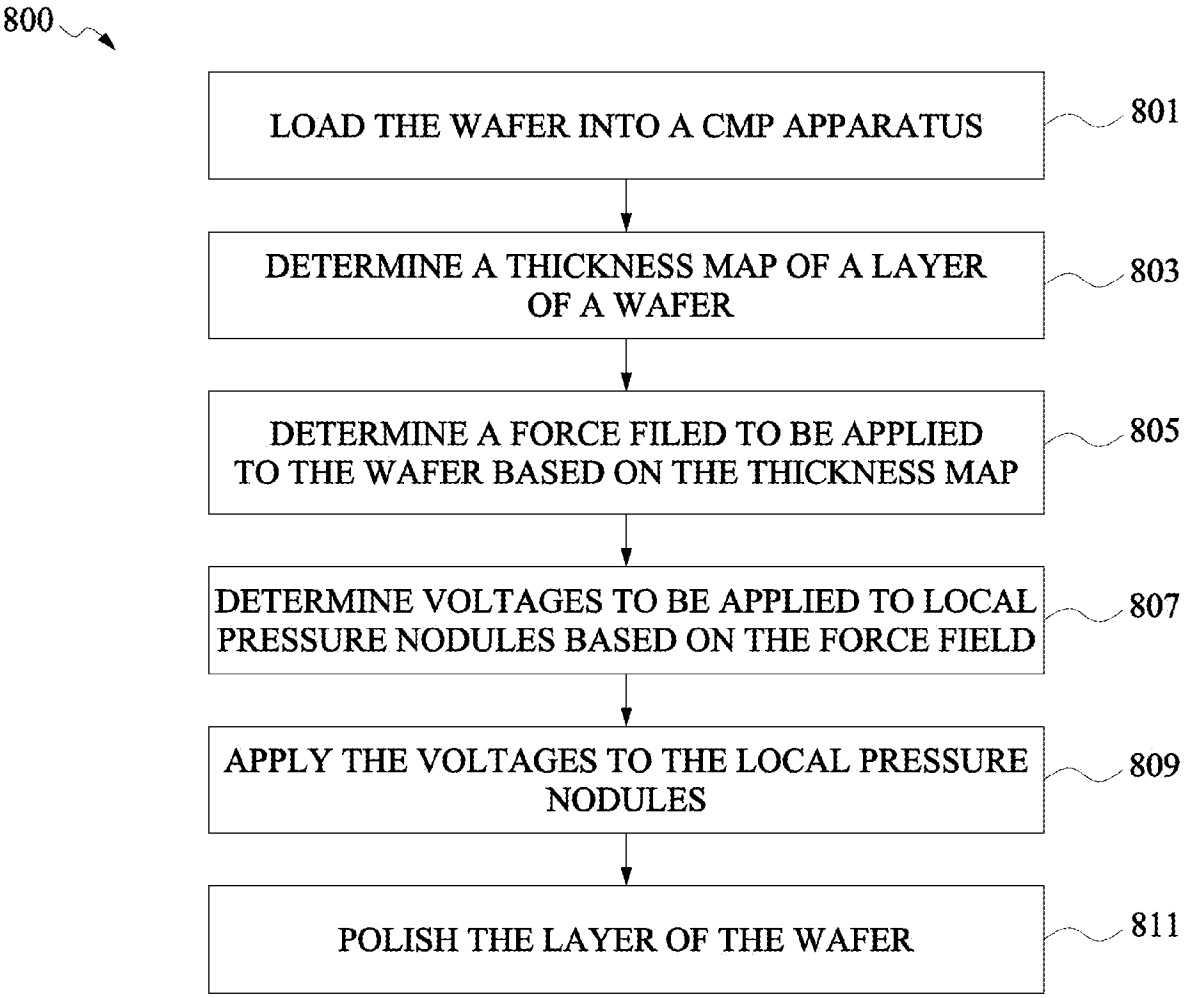
FIG. 8 is a flow diagram of a method of polishing a semiconductor wafer in accordance with some embodiments.

FIG. 8 is a flow diagram of a method 800 of polishing a semiconductor wafer in accordance with some embodiments. In the illustrated embodiment, the thickness measurement apparatus is a part of the CMP apparatus 100 and the thickness map of the bottommost layer 307 is determined after loading the wafer 330 into the CMP apparatus 100 in step 801. In some embodiments, steps 803, 805, 807, 809 and 811 of the method 800 may be similar to steps 701, 703, 705, 709 and 711, respectively, of the method 700 described above with reference to FIG. 7 and the description is not repeated herein.

Various embodiments presented herein may provide several advantages. Embodiments such as described herein allow for applying a non-uniform force field to the wafer such that local values of the non-uniform force field may be independently controlled. In various embodiments, local pressure nodules formed of a piezoelectric material may be employed to apply the non-uniform force field to a wafer. In various embodiments, the non-uniform force field may be determined based on a non-uniform thickness of a polished layer and allow for compensating for a thickness asymmetry or a thickness non-uniformity of the polished layer. Various embodiments further allow for reducing polishing time and increasing a wafer per hour (WPH) output of a CMP apparatus.

In accordance with an embodiment, a polishing apparatus includes a polisher head. The polisher head includes a membrane, and a first local pressure nodule and a second local pressure nodule physically contacting the membrane, the first local pressure nodule being configured to apply a first local force to the membrane, the second local pressure nodule being configured to apply a second local force to the membrane, the first local pressure nodule and the second local pressure nodule being independently controllable.

In accordance with another embodiment, a method includes attaching a wafer to a membrane of a polisher head. A first applied local force is applied to the membrane using a first local pressure nodule of the polisher head, the first local pressure nodule physically contacting the membrane. A second applied local force is applied to the membrane using a second local pressure nodule of the polisher head, the second local pressure nodule physically contacting the membrane, the first local pressure nodule and the second local pressure nodule being independently controllable. An exposed layer of the wafer is polished.

In accordance with yet another embodiment, a method includes determining a thickness map of a first side of a wafer. A desired force field to be applied to the wafer is determined based on the thickness map. A second side of the wafer is attached to a membrane of a polisher head, the second side being opposite the first side. An applied force field based upon the desired force field is applied to the membrane using a plurality of local pressure nodules of the polisher head, the plurality of local pressure nodules being configured to apply the applied force field to the membrane. The first side of the wafer is polished.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A polishing apparatus comprising:

a polisher head, the polisher head comprising:

a membrane; and a first local pressure nodule and a second local pressure nodule physically contacting the membrane, the first local pressure nodule being configured to apply a first local force to the membrane, the second local pressure nodule being configured to apply a second local force to the membrane, the first local pressure nodule and the second local pressure nodule being independently controllable.

2. The polishing apparatus of claim 1, wherein the first local pressure nodule and the second local pressure nodule comprise a piezoelectric material.

3. The polishing apparatus of claim 1, wherein the first local force is different from the second local force.

4. The polishing apparatus of claim 1, wherein the first local pressure nodule is configured to receive a first voltage, wherein the second local pressure nodule is configured to receive a second voltage, and wherein the first voltage is different from the second voltage.

5. The polishing apparatus of claim 1, wherein the polisher head further comprises:

a carrier; and a retainer ring attached to the carrier, the membrane, the first local pressure nodule and the second local pressure nodule being disposed within an opening in the retainer ring.

6. The polishing apparatus of claim 1, wherein a width of the first local pressure nodule is equal to a width of the second local pressure nodule.

7. The polishing apparatus of claim 1, wherein a width of the first local pressure nodule is between about 1.5 cm and about 3.5 cm.

8. A method comprising:

attaching a wafer to a membrane of a polisher head;

applying a first applied local force to the membrane using a first local pressure nodule of the polisher head, the first local pressure nodule physically contacting the membrane;

applying a second applied local force to the membrane using a second local pressure nodule of the polisher head, the second local pressure nodule physically contacting the membrane, the first local pressure nodule and the second local pressure nodule being independently controllable; and polishing an exposed layer of the wafer.

9. The method of claim 8, wherein the first local pressure nodule and the second local pressure nodule comprise a piezoelectric material.

10. The method of claim 8, wherein the first applied local force is different from the second applied local force.

11. The method of claim 8, wherein applying the first applied local force and the second applied local force to the membrane comprises:

determining a thickness map of the exposed layer; and determining a first desired local force and a second desired local force based on the thickness map.

12. The method of claim 11, wherein determining the thickness map of the exposed layer comprises measuring local thicknesses of the exposed layer.

13. The method of claim 11, wherein applying the first applied local force and the second applied local force to the membrane further comprises:

determining a first voltage based on the first desired local force;

determining a second voltage based on the second desired local force;

applying the first voltage to the first local pressure nodule; and applying the second voltage to the second local pressure nodule.

14. The method of claim 13, wherein the first voltage is different from the second voltage.

15. A method comprising:

determining a thickness map of a first side of a wafer;

determining a desired force field to be applied to the wafer based on the thickness map;

attaching a second side of the wafer to a membrane of a polisher head, the second side being opposite the first side;

applying an applied force field based upon the desired force field to the membrane using a plurality of local pressure nodules of the polisher head, the plurality of local pressure nodules being configured to apply the applied force field to the membrane; and polishing the first side of the wafer.

16. The method of claim 15, wherein the plurality of local pressure nodules comprises a piezoelectric material.

17. The method of claim 15, wherein determining the thickness map of the first side of the wafer comprises measuring local thicknesses of an exposed layer on the first side of the wafer.

18. The method of claim 15, wherein the desired force field is proportional to the thickness map.

19. The method of claim 15, wherein applying the applied force field to the membrane comprises:

determining a plurality of voltages based on the desired force field; and applying the plurality of voltages to corresponding local pressure nodules.

20. The method of claim 15, wherein the applied force field is a non-uniform force field.

* * * * *